US005772478A

United States Patent [19]

Kuempel et al.

[11] Patent Number: 5,772,478

[45] Date of Patent: Jun. 30, 1998

[54] CONNECTOR HOUSING HAVING SECONDARY LOCKING FEATURE

[75] Inventors: Dietrich Wilhelm Kuempel, Rüsselsheim; Patrik Mueller, Frankenthal; Andreas Krull, Langen, all of Germany

[73] Assignee: The Whitaker Corporation, Wilmington, Del.

[21] Appl. No.: 765,008

[22] PCT Filed: May 31, 1995

[86] PCT No.: PCT/IB95/00416

§ 371 Date: Dec. 10, 1996

§ 102(e) Date: Dec. 10, 1996

[87] PCT Pub. No.: WO96/01508

PCT Pub. Date: Jan. 18, 1996

[30] Foreign Application Priority Data

Jul. 1, 1994 [GB] United Kingdom ..... 9413305

[51] Int. Cl.[6] ..... H01R 13/436

[52] U.S. Cl. ..... 439/752

[58] Field of Search ..... 439/752, 595

[56] References Cited

U.S. PATENT DOCUMENTS

| | | | |
|---|---|---|---|
| 4,750,893 | 6/1988 | Sueyoshi et al. | 439/596 |
| 4,934,963 | 6/1990 | Gardner et al. | 439/752 |
| 5,135,416 | 8/1992 | Hass et al. | 439/752 |

FOREIGN PATENT DOCUMENTS

| | | |
|---|---|---|
| 0 352 087-B1 | 1/1990 | European Pat. Off. . |
| 0 424 887 A1 | 5/1991 | European Pat. Off. . |
| 87 00 212.4 | 6/1987 | Germany . |

*Primary Examiner*—Gary F. Paumen
*Attorney, Agent, or Firm*—Bradley N. Ditty

[57] ABSTRACT

An electrical connector housing (2) for housing an electrical terminal within a body (4). The body (4) having a channel (14) wherein the terminal is received and a latch (66) movable between an unlocked position outside of said channel (N) and a locked position blocking at least a portion of said channel (14) so that the terminal is prevented from being dislodged. The electrical connector housing being characterized in that the latch (66) is actuated by a locking member (8) that is rotatable between the locked and unlocked positions upon said housing body (4).

14 Claims, 7 Drawing Sheets

CONNECTOR HOUSING HAVING SECONDARY LOCKING FEATURE

BACKGROUND OF THE INVENTION

1. Field of the Invention

The present invention relates to an electrical connector housing in which a secondary lock is provided to secure terminals within a housing body.

2. Summary of the Prior Art

Typical electrical connectors employ an insulative housing member to house and retain an electrical terminal. The housing and the terminal are constructed to be matable with a complementary electrical connector or component. Normally, the mating housings will include a positive locking feature for engaging the complementary connector. When the electrical interconnection is in a high vibration environment, such as a vehicle or industrial machine, it is not only necessary that the mating connector housings be securely attached to one another, but also that the electrical terminals contained therein are prevented from coming loose from the housing. In order to accomplish that locking lances which are part of the terminal and interfere with a part of the housing, or vica-versa, may be used.

Not only is the vibration a concern, but also that pulling on the conductors or wires attached to the terminals, such as during maintenance, does not result in interruption of the electrical connection by dislodging the terminal from the housing. In order to assure that the terminals are retained within the housing, many conventional electrical connectors incorporate a secondary locking or terminal position assurance member. While there are numerous ways of accomplishing the goal of maintaining the terminal within the housing, a common concept is to somehow, after the terminal is seated within the connector housing, block the direction of entry of the terminal so that it is not possible for the terminal to be removed. Common solutions include a connector housing incorporating resilient fingers that are displaceable out of the way as the contact is inserted and later, once the contact has passed, return to their original position. Other connectors use a comb or another member that can be inserted into the housing and engage a surface of the terminal. While these constructions have provided viable solutions to the problem, they can be mis-assembled resulting in damage to the contact, the housing, or the secondary locking member itself. In addition, it is normally necessary to disassemble the secondary locking member from the housing to install or remove contacts. What is still needed is a electrical connector having a secondary locking member where the connector may be fully assembled prior to the insertion of the terminal and then by actuating the secondary locking member, the terminal is retained therein.

SUMMARY OF THE INVENTION

DE-U-8700212 discloses an electrical connector having a connector housing for housing an electrical terminal where said housing comprises a body having a channel for receiving the terminal and a locking member cooperating with a latch that is moveable between an unlocked position outside of the channel and a locked position extending into and blocking at least a portion of said channel such that when the terminal is housed therein, the terminal is blocked from exiting the channel by the latch, said latch being moveable as a result of eccentric rotation of the locking member relative to the longitudinal axis of the channel.

It is an object of this invention to provide an electrical connector having a secondary locking member to ensure that the electrical terminal is retained therein.

It is another object of this invention to provide an electrical connector housing that Is easy to operate and inexpensive to manufacture.

It is yet another object of this invention to provide an electrical connector housing having a secondary locking member that is retained upon the housing body in both the locked and unlocked positions while being rotatable therebetween.

It is still yet another object of this invention to provide an electrical connector that cannot be mated with a complementary component unless the secondary locking is fully activated.

The objects of the invention have been achieved by providing an electrical connector housing for housing an electrical terminal where the housing includes a body having a channel wherein the terminal Is received and a latch movable between an unlocked position which is outside of said channel and a locked position blocking at least a portion of said channel such that when the terminal is positioned within the channel, the terminal is prevented from exiting the channel by the latch. The connector housing being characterized in that the latch is actuated by a locking member that is rotatable relative to the housing body.

Advantageously, the connector housing of the present invention is easy to assemble, simple to use, and easily manufactured. The rotational actuation makes this connector housing especially suitable for applications involving terminal receiving channels that are located about a common central axis. In one embodiment of the invention the locking member is disposed on the outside of the housing body and includes a profile that prevents mating with a complementary connector if the latch has not been moved into a locked position.

BRIEF DESCRIPTION OF THE DRAWINGS

An embodiment of the invention will now be described by way of reference to the drawings, where.

DETAILED DESCRIPTION OF THE PREFERRED EMBODIMENT

Figure 2:
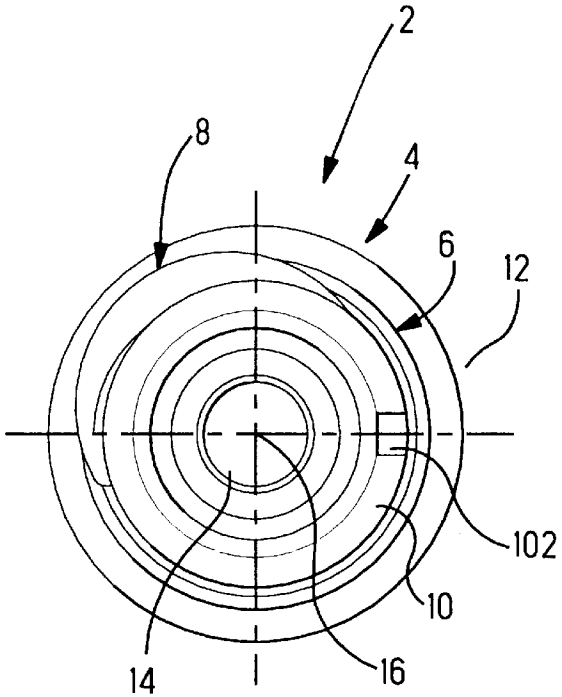
FIG. 2 is a front end view of the connector housing of FIG. 1.
Figure 1:
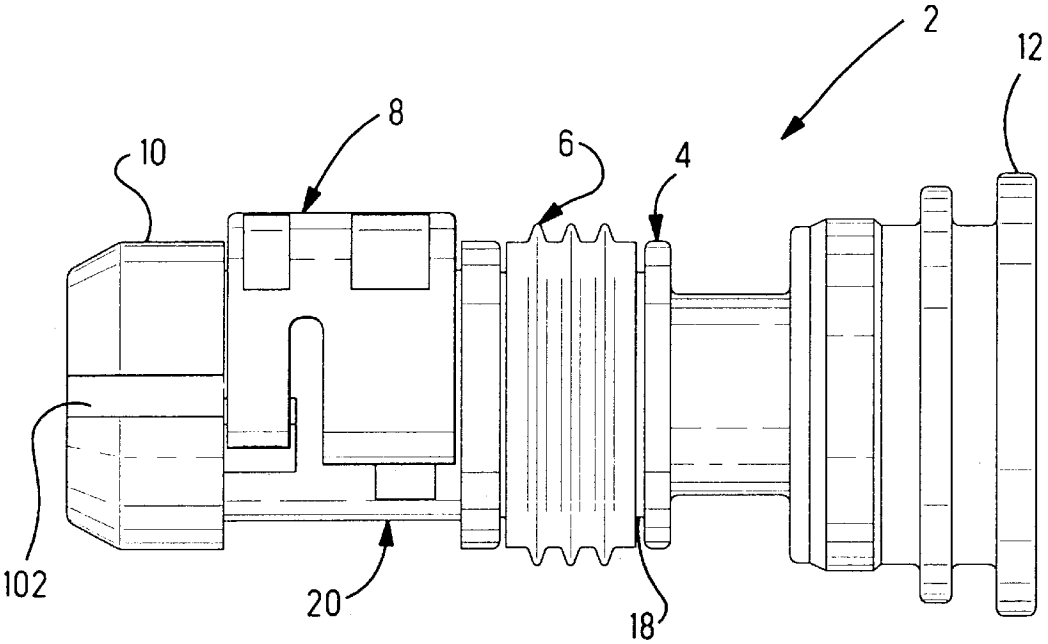
FIG. 1 is a side view of a preferred embodiment of the connector housing.

With reference first to FIGS. 1 and 2, an electrical housing is shown at 2 comprising a housing body 4, a seal member 6 and a locking member 8. The connector body 4 includes a front end 10, a rear end 12, and has a terminal receiving channel 14 passing therethrough. In this embodiment, the features of the connector housing 2 are generally cylindrical. The channel 14 is also cylindrical as in this embodiment the channel 14 is constructed to receive cylindrical-style pin or receptacle terminals (not shown) of corresponding cylindrical construction. It is important to know that while in the preferred embodiment cylindrical features, and components, have been utilized, this is not limiting on the invention as many other shapes may be used depending on the application.

Figure 12:
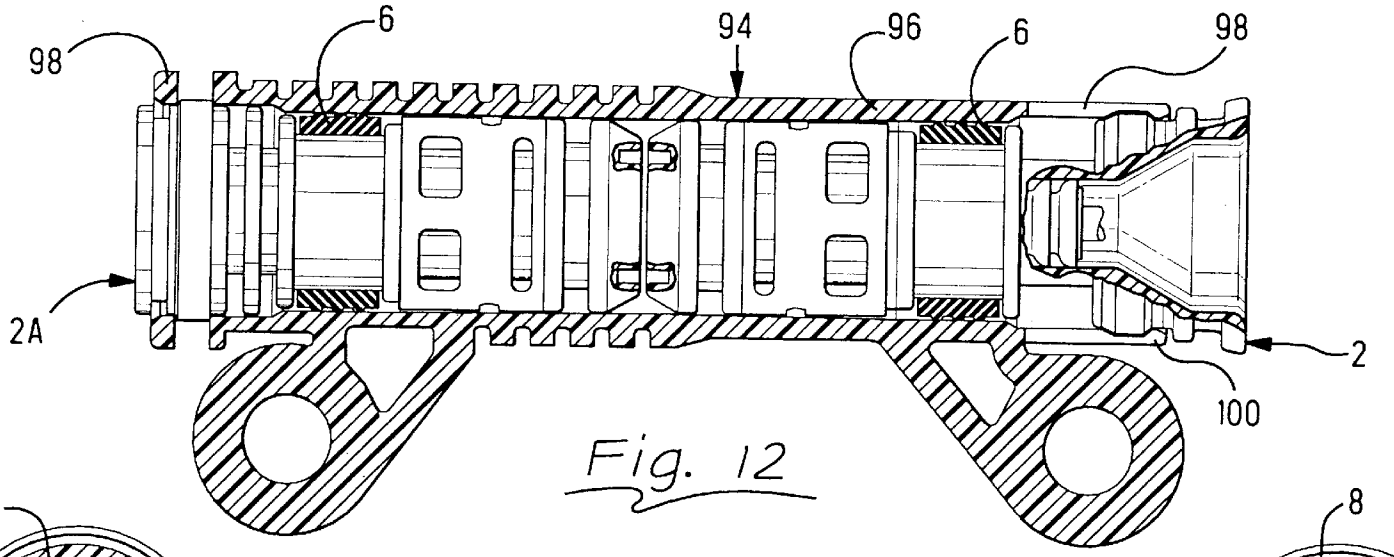
FIG. 12 is a partial cross-sectional view showing complementary connectors according to the present invention mated within a housing.

In this embodiment, the connector body 4 and the channel 14 have a common longitudinal axis 16. The seal member 6 is disposed upon the connector body 4 at seal seat 18. The seal member 6 is a resilient body of conventional construction which is advantageously located to the rear end 12 of locking member 8 in order to provide an environmental seal for the electrical interconnection that occurs when this connector housing 2 is mated with a complementary connector 2A (FIG. 12). The locking member 8 is mounted upon bearing post 20 and is movable between a locked position and an unlocked position, as will be described below.

Figure 3:
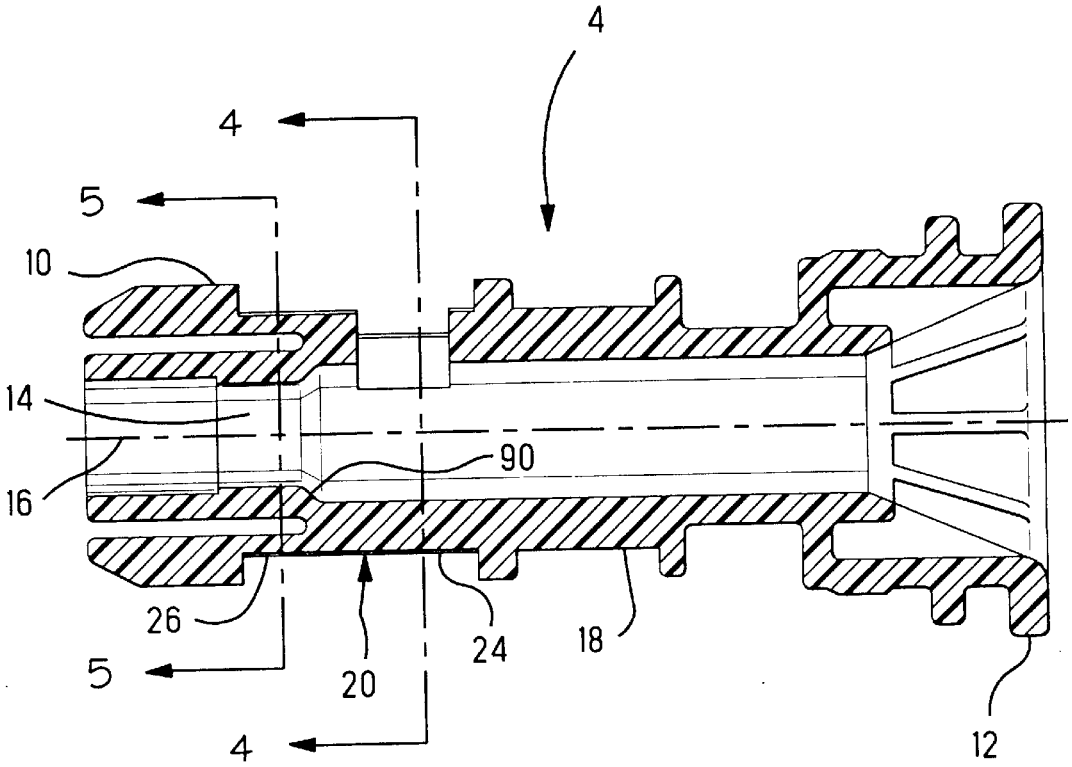
FIG. 3 is a cross-section of the connector body of FIG. 1.
Figure 4:
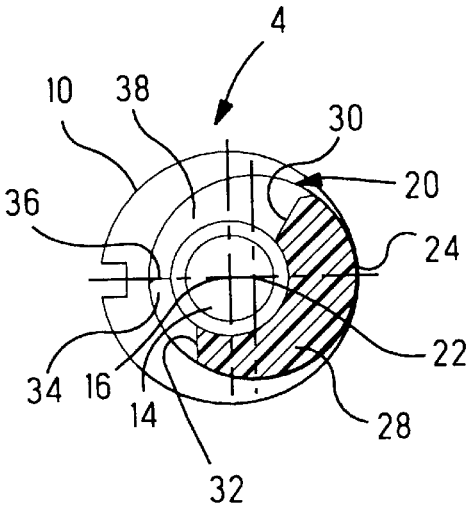
FIG. 4 is a sectional view taken along lines 4—4 of FIG. 3 of the connector body of FIG. 1.
Figure 5:
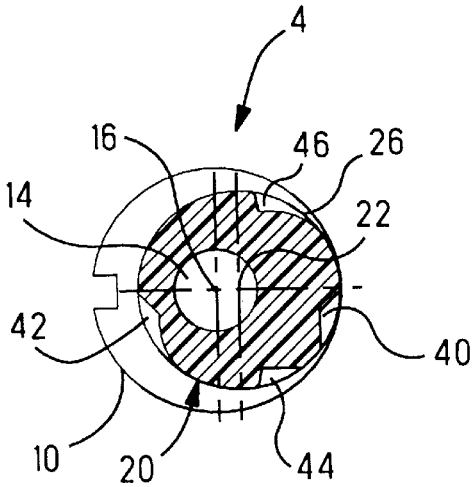
FIG. 5 is a sectional view taken along lines 5—5 of FIG. 3 of the connector body of FIG. 1.

With reference now to FIGS. 3–5, the connector body 4, and more particularly the bearing post 20, will be further described. The bearing post 20 is a basically cylindrical member effective of a diameter less than the outer diameter of the front end 10 of the housing body 4. The bearing post 20 has a central longitudinal axis 22 that is eccentric to the central longitudinal axis of the connector body 4 and the channel 14. The bearing post 20 has a rear section 24 and a front section 26, best shown in cross-sectional views of FIGS. 4 and 5 respectively. The rear section 24 is segmented in cross-section as shown to provide a support section 28 of shoulders 30 and 32. Extending from shoulder 32 is a tongue 34 having an abutment surface 36 where between the tongue 34 and the shoulder 30 are the locked and unlocked positions of the locking member 8, as will be described below. By segmenting the bearing post, an opening 38 is formed between the shoulders 32 and 30.

With reference now to FIG. 5, the front section 26 of the bearing post 20 is shown in cross-section. Along the front section 26, which is continuous from the rear section 24, are a number of features that are engageable by the locking member 8 in order to position and retain the locking member 8 in the locked and unlocked positions. These features are the unlocked seats 40, 42 and the locked seats 44, 46, which will be more fully described below.

Figure 6:
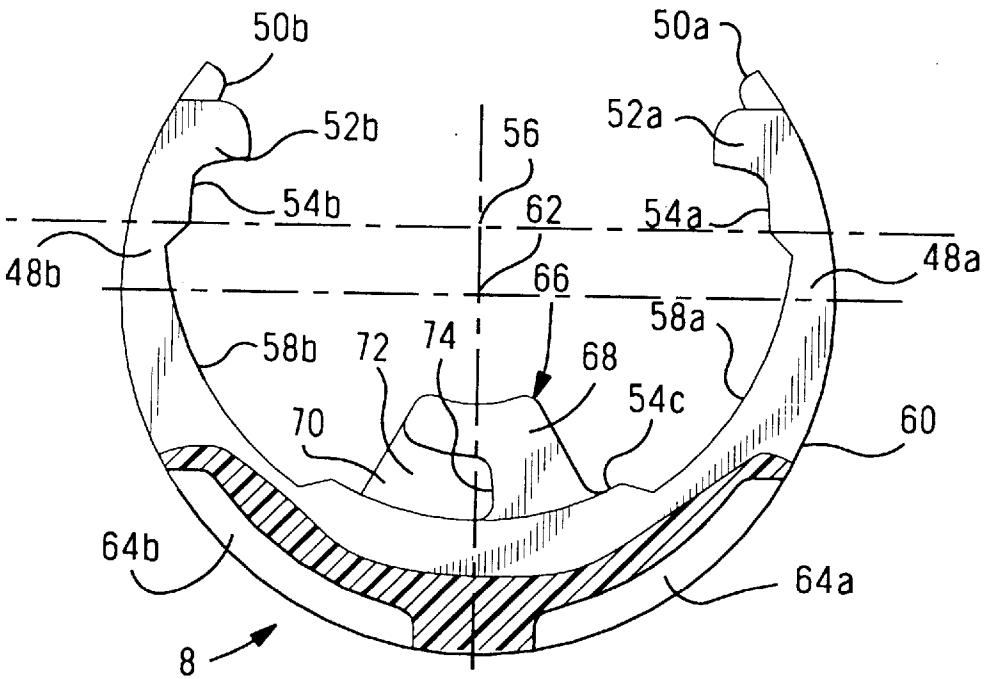
FIG. 6 is a partially broken-away end view of the locking member and latch of FIG. 1.
Figure 7:
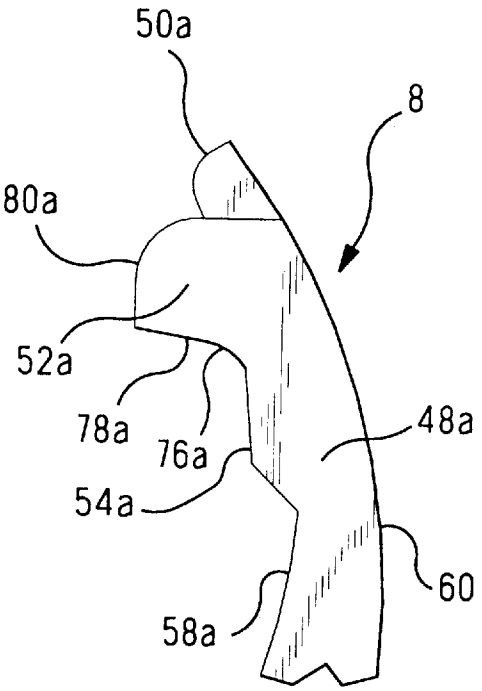
FIG. 7 is a detailed end view of FIG. 6.

With reference now to FIGS. 6 and 7, the locking member 8 is a generally C-shaped sleeve element having arms 48*a*, 48*b* with respective free ends 50*a*, 50*b*. Each free end 50*a*, 50*b* including a latching lug 52*a*, 52*b* respectively. The locking member 8 having radial segments 54*a*, 54*b*, 54*c* which define an inner radial surface about a central axis 56, which corresponds to the central axis 22 of bearing post 20. The radius of these segments 54*a*–*c* being equal to the outer effective radius of the bearing post 20 so that the locking member 8 may be received and rotated thereupon. Disposed between the radial sections 54*a*–*c* are relieved portions 58*a* and 58*b*. An outer surface 60 of the locking member 8 has a central axis 62 offset advantageously offset, in this embodiment for purposes described below, from the central axis 50 of the inner surfaces 54*a*–*c*. The outer surface 60 is disposed at a radial distance corresponding to the front end 10 of the body 4. Relieved portions 64*a* and 64*b* are included on the outer surface 60. The relieved portions 58*a*, 58*b* between the inner surfaces 54*a*–*c* and the relieved portions 64*a*, 64*b* along the outer surface 60 provide material savings and enable the ends 50*a*, 50*b* of arms 48*a*, 48*b* to have greater resiliency.

Disposed along inner surface 54*c* is a latch 66 at a location corresponding to the rear section 24 of bearing post 20. The latch 66 includes an L-shaped finger 68 which is constructed to fit behind a shoulder of the terminal (not shown) to be retained within the channel 14. The L-shaped finger 68 is supported by a support plate 70 disposed rearward thereof to form a U-shaped opening 72 that is open on one side for receiving the tongue 34.

With reference now to FIG. 7, one of the ends 50*a* of the locking member 8 will be described in more detail. As the arms 48*a*, 48*b* are basically similar, only one need be described in detail. The latch 52*a* extends inward from inner surface 54*a*. A substantial radius 76*a* is included between the inner surface 54*a* and the latch 52*a* for resiliently deflecting the arm 48*a* in a manner that will be described below. The latch itself 52*a* includes shoulders 78*a* and 80*a*. These shoulders 78*a*, 80*a* are engaged by the features 40, 42, 44, 46 on the bearing post 20 at the front section 26 in order to maintain the locking member 8 in either the unlocked position or the locked position.

Figure 8:
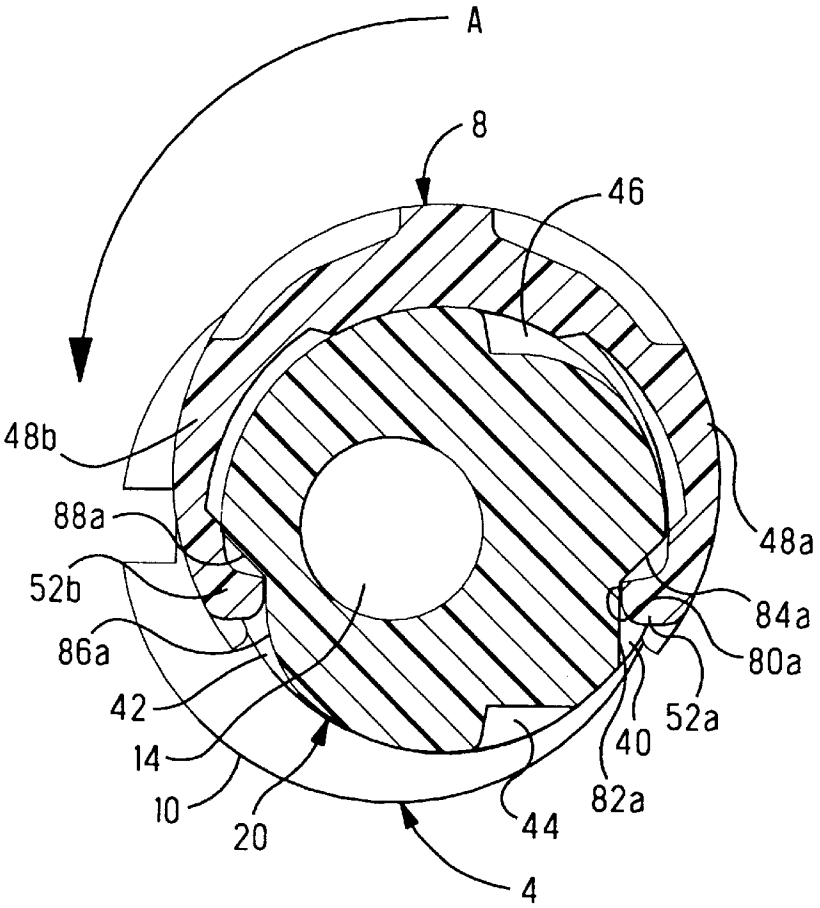
FIG. 8 is a sectional view taken along lines 8—8 of FIG. 1 showing the connector housing when in an unlocked position.
Figure 9:
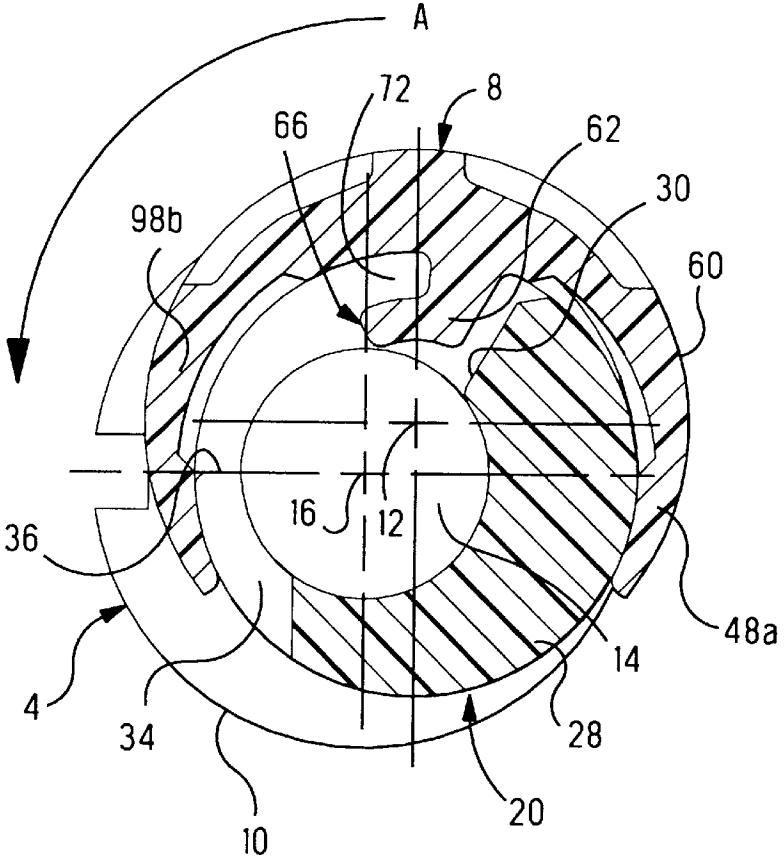
FIG. 9 is a sectional view taken along line 9—9 of FIG. 1 showing the connector housing when in an unlocked position.

With reference now to FIGS. 8 and 9, the locking member 8 is shown on the bearing post 20 at the unlocked position with the views being taken at a location corresponding to the views of FIG. 4 and FIG. 5 respectively. First with reference to FIG. 9, the latch 66 is shown disposed outside of the terminal receiving channel 14. In this position, the outer surface 60 of the locking member 8 may be seen to extend outside of the confines of the front end 10 of the connector housing body 4 (also shown in FIG. 1). In this unlocked position, a terminal (not shown) would be free to be inserted or removed from the connector housing 4. With reference now to FIG. 8, the locking member 8 is observed with the latches 52*a*, 52*b* being engaged within respective unlocked seats 40, 42. Unlocked seat 40 includes a stop shoulder 82 and a camming surface 84. Unlocked seat 42 includes a cam surface 86 and a transition surface 88.

In order to rotate the locking member 8 into the locked position where the latch arms 52*a*, 52*b* are received within locked seats 44, 46, the locking member 8 must be rotated in the direction of arrow A. As this occurs, latch 52*a* will ride up camming surface 84*a* while latch 52*b* rides along camming surface 86*a*. The effect of this is to separate the legs 48*a*, 48*b* enabling the locking member 8 to be rotated upon the bearing post 20 into the locked position. As the locking member is rotating on an eccentric surface of the bearing post 20 relative the channel 14, rotation results in the latch 66 moving into the channel 14 to at least partially obstruct the passageway. Any rotation from the unlocked position counter to arrow A is resisted by shoulder 82*a* abutting shoulder 80*a*. If rotation is forced, leg 48*b* can be displaced as it rides over camming surface 88*a* allowing the locking member 8 to be removed from the bearing post 20.

Figure 10:
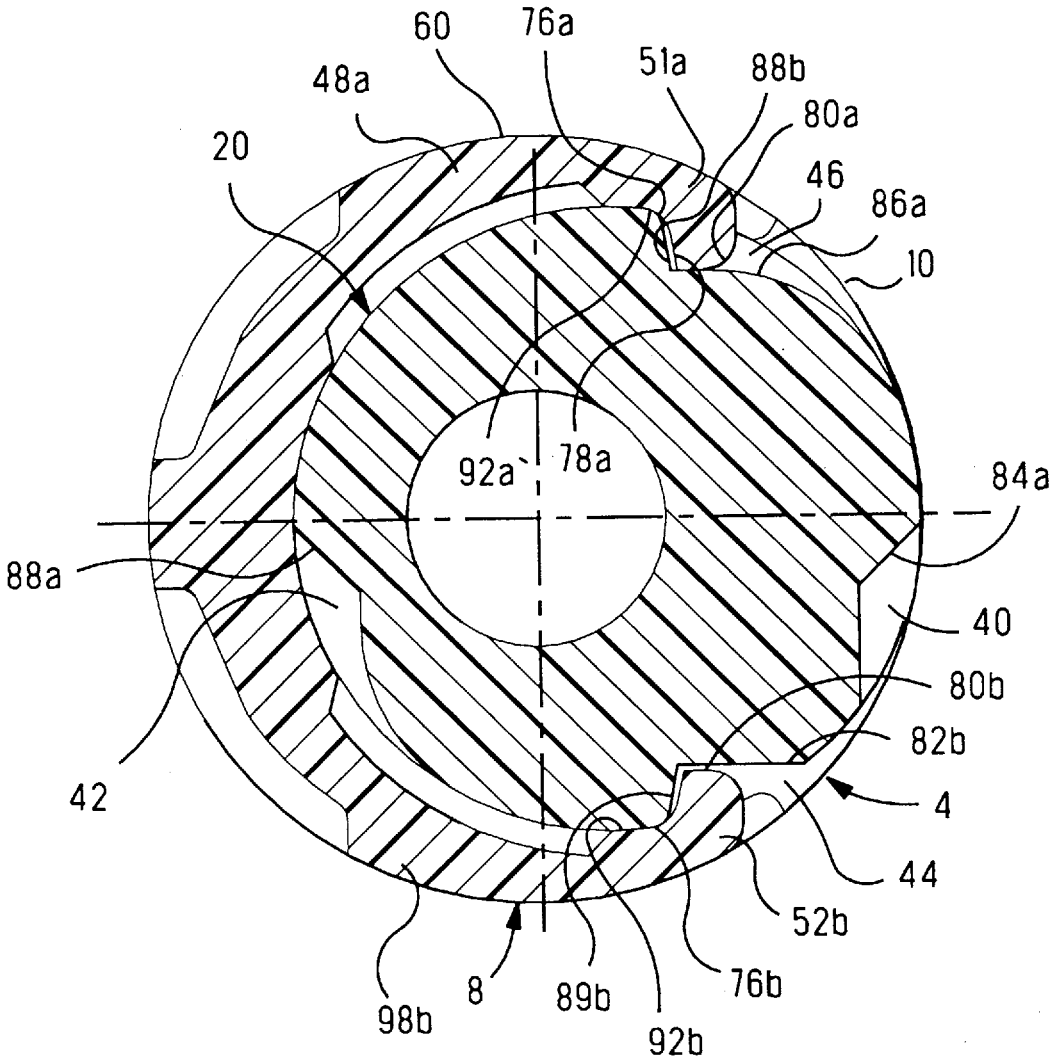
FIG. 10 is a sectional view corresponding to the section of FIG. 8 taken when the connector housing is in a locked position.
Figure 11:
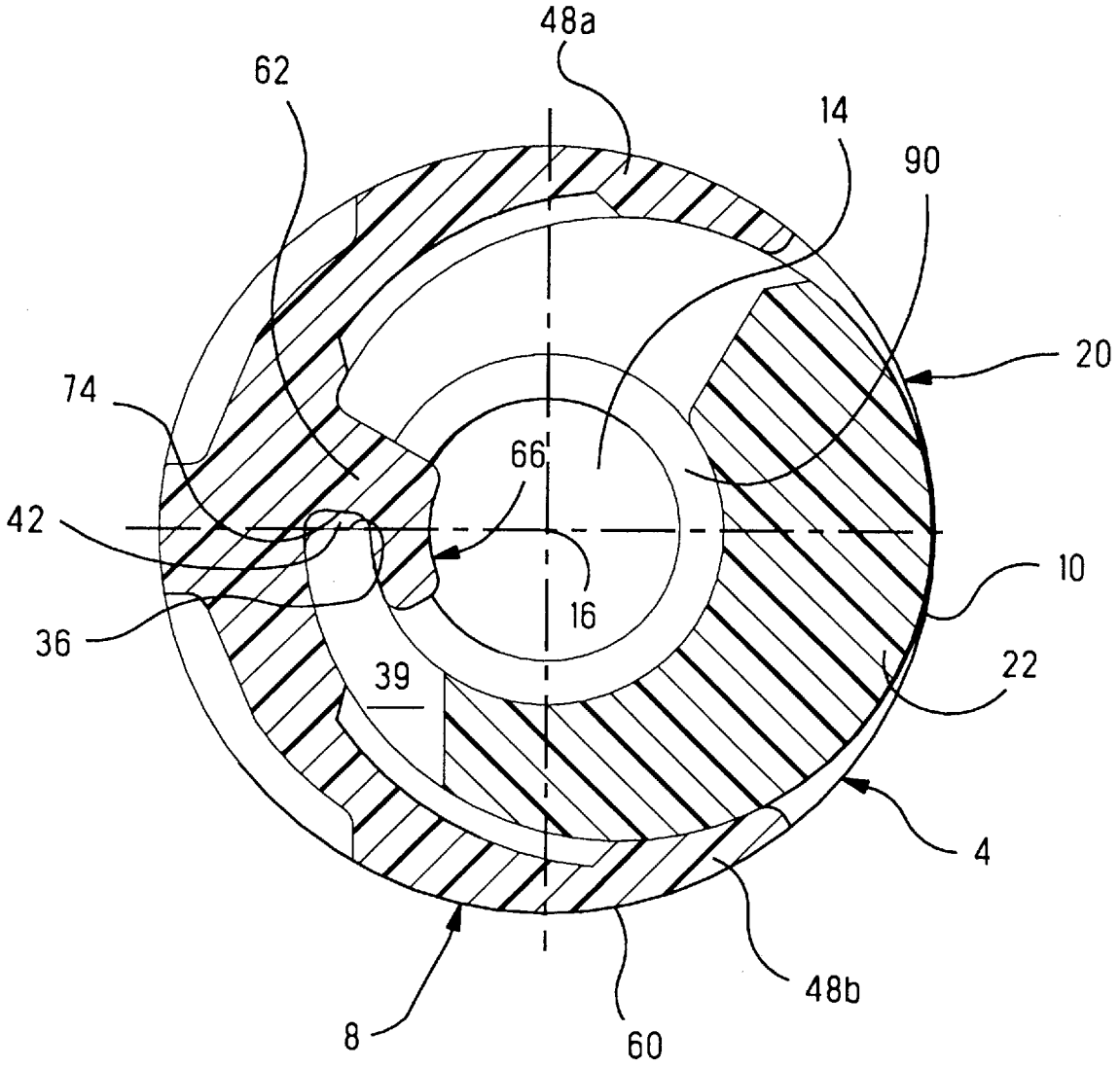
FIG. 11 is a sectional view corresponding to FIG. 9 taken when the connector housing is in a locked position.

With reference now to FIGS. 10 and 11, the locking member 8 is shown in the locked position. With reference first to FIG. 11, the latch 66 is shown extending into the channel 14. As seen in FIG. 3, the receiving channel 14 includes a shoulder 90 forward of line 4—4. As FIG. 11 is taken at line 4—4, it is apparent that the latch 66 forms a captivating region between the shoulder 90 wherein the shoulder of a terminal (not shown) may be captivated. It is further possible that the latch 66 may directly engage the terminal (not shown) by fitting between two shoulders included upon the terminal or fitting into a notch.

In the locked position, the L-shaped finger 62 receives the tongue 34 of the bearing post 20 such that the stop shoulder 74 is brought into close approximation with the abutment surface 36. In this position, the support 70 is overlying the tongue 34. The combination of the post 20 and the locking member 8 is such that the outer surface 60 of the locking member 8 complies with the profile of the front end 10 of the housing body 4. This is achieved by properly sizing the radius of the outer surface 60 and selecting the relationship of the centre of the inner surfaces 54*a–c* and outer surface 60 to correspond to the relationship of the centres of the housing body Y and channel with the bearing member 20.

With reference now to FIG. 10, upon rotation of the locking member 8 in the direction illustrated by arrow A in FIG. 8, the locking latches 52*a*, 52*b* are received within the locked seats 46, 44 respectively. The details of these seats 44, 46 correspond generally to the details of the unlocked seats 40, 42 and have the designation "b" for ease of comparison. As the locking member 8 is rotated, the latches 52*a*, 52*b* slide over the outer surface of the post 20. As latch 52*a* approaches locked seat 46, it slides in along cam surface 86*b*. Upon further travel along cam surface 86*b*, latch 52*b* falls into locked seat 44. At this point, the latches 52*a*, 52*b* are retained within their appropriate locked seats 46, 44 with shoulders 78*a*, 78*b* abutting surfaces 84*b* and 88*b*. The locking member 8 is prevented from further rotation in the direction of arrow A as corresponding pairs of shoulder surfaces 78*a*, 88*b* and 80*b*, 82*b* essentially squarely abut each other. In this relationship it is very difficult to enhance further rotation of the locking member 8. However, if it is desired to return to the unlocked position, the transitions 92*b* between the outer surface of the bearing post 20 and shoulder 84*b* interacts with radius 76*b* to cam the latch 52*b* outward. This enables, although with difficulty, return of the locking member 8 to the unlocked position as surface 80*a* cams outward upon surface 86*b*. It is important to note, by way of comparison the difference in steepness of the orientations of shoulders 88*a* and 88*b* and shoulders 84*a* and 84*b*. This difference of steepness assures the more positive locking within the locked seats 44, 46.

Figure 13:
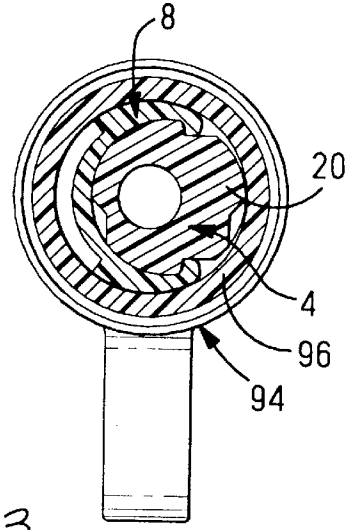
FIG. 13 is a sectional view taken along lines 13—13 of FIG. 12.
Figure 14:
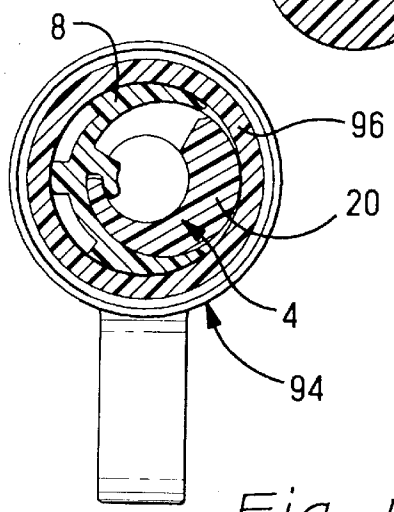
FIG. 14 is a sectional view taken along lines 14—14 of FIG. 12.

With reference now to FIG. 12, a housing 94 is shown having a cylindrical, sleeve-like body 96 wherein a connector housing 2 according to the present invention may be received. The sleeve-like portion 96 is constructed to closely receive the connector housing 2 so that the seal member 6 forms an interference therewith creating an advantageous environmental seal. The sleeve members 96 may also include a plurality of resilient finger portions 96 having latching nubs 100 thereupon to engage features of the connector body 4 for retention purposes. In an alternative embodiment, electrical connector 2A is shown. The electrical connector housing 2A is configured so that the fingers 98 have openings incorporated therein for engaging an outwardly extending surface of the connector body 4. As can be further observed in FIG. 13 and FIG. 14, when the locking member 8 is positioned in the locked position, the connectors 2, 2A may be received within the sleeve housing 96. By way of comparison in FIG. 2, where the locking member 8 is shown in the unlocked position and extending outwardly from the connector housing 4, it is not possible for the connector housing to be inserted within sleeve 96.

Advantageously, once the connector housing 2 is inserted into the sleeve 96, the locking member 8 is further prevented from returning to the unlocked position as it is not possible for the locking member 8 rotate therein in order to extend outward from the connector body 4 (the position shown in FIG. 2). In connector housings where a non-cylindrical terminal or that incorporate a plurality of terminals, a keying slot 102 may be incorporated for polarization. Furthermore, it is not necessary to have a sleeve member 96 that is separate and distinct from the mating connectors 2. A shroud, that would function as the sleeve 96 could be incorporated into a bulkhead connector or a mating connector. Finally, although the preferred embodiment has been described with reference to a single axially disposed terminal contained therein, it is fully envisioned that invention could be applied to connector housings incorporating multiple terminals or the locking member could be carried within an eccentric nest as opposed to the post, these modifications would be apparent to one having skill in the art.

We claim:

1. An electrical connector housing for housing an electrical terminal, said housing comprising a body having a channel for receiving the terminal and a locking member cooperating with a latch that is movable between an unlocked position outside of said channel and a locked position extending into and blocking at least a portion of said channel such that when the terminal is housed therein, the terminal is blocked from exiting the channel by the latch, said latch being movable as a result of eccentric rotation of the locking member relative the longitudinal axis of the channel, characterized in that the latch is formed integrally with the locking member and the locking member is formed as an eccentric, such that in the locked position the outer surface of the locking member is flush with the outer surface of the housing.

2. The electrical connector housing of claim 1, further characterized in that the longitudinal axis of the channel is same as the longitudinal axis of the body.

3. The electrical connector housing of claim 1, further characterized in that the latch is an L-shaped, hook-like member.

4. The electrical connector housing of claim 1, further characterized in that the housing body includes a bearing post upon which said locking member is rotatable, said bearing post being eccentric to the longitudinal axis of the channel or the housing.

5. The electrical connector housing of claim 4, characterized in that said locking member includes a C-shaped sleeve portion with the latch interconnected with the internal surface thereof.

6. The electrical connector housing of claim 5, characterized in that said sleeve portion of the locking member includes an inner radius having an inner axis corresponding to the outer radius of the bearing post.

7. The electrical connector housing of claim 5, further characterized in that said locking member includes an outer radius having a central axis offset from the centre of the inner axis, a distance corresponding to the eccentricity from said channel, said offset being further defined so that in the locked position, the outer surface of the locking member is within an outer surface of the connector body and when in the unlocked position, the outer surface of the locking member extends beyond the outer surfaces of the body member, whereby the connector housing is prevented from being inserted into a receptacle.

8. The electrical connector housing of claim 7, further characterized in that the latch includes an L-shaped finger constructed to fit behind a shoulder of the terminal, said finger having a support plate affixed along one side thereof.

9. The electrical connector housing of claim 5, wherein the C-shaped element includes free arms that include latching lugs that correspond to locked seats in the locked position and unlocked seats in the locked position.

10. The electrical connector housing of claim 9, further characterized in that the seats are disposed along the bearing post.

11. The electrical connector housing of claim 9, further characterized in that the seats are configured to permit movement in one direction between the locked and unlocked seats while preventing movement in the other direction.

12. The electrical connector housing of claim 1, further characterized in that the connector housing receives a single terminal.

13. The electrical connector housing of claim 4, further characterized in that the bearing post includes an opening through which the latch extends into the channel.

14. The electrical connector housing of claim 9, further characterized in that at least one of the seats are profiled such that displacement of the locking member outside of the displacement between the locked and unlocked positions, enables the locking member to be removed from the housing.

* * * * *